US010048009B2

(12) United States Patent
Kolb

(10) Patent No.: US 10,048,009 B2
(45) Date of Patent: Aug. 14, 2018

(54) HEAT EXCHANGER TUBE WITH CONCAVE-SHAPED END AND METHOD OF MANUFACTURING A HEAT EXCHANGER TUBE WITH CONCAVE-SHAPED END

(71) Applicant: Enterex America LLC, Westbrook, CT (US)

(72) Inventor: John A. Kolb, Westbrook, CT (US)

(73) Assignee: ENTEREX AMERICA LLC, Westbrook, CT (US)

( * ) Notice: Subject to any disclaimer, the term of this patent is extended or adjusted under 35 U.S.C. 154(b) by 433 days.

(21) Appl. No.: 14/482,347

(22) Filed: Sep. 10, 2014

(65) Prior Publication Data

US 2015/0300742 A1 Oct. 22, 2015

Related U.S. Application Data

(60) Provisional application No. 61/980,252, filed on Apr. 16, 2014, provisional application No. 61/980,288, filed on Apr. 16, 2014.

(51) Int. Cl.

| | |
|---|---|
| ***F28F 9/02*** | (2006.01) |
| ***F28D 1/053*** | (2006.01) |
| ***B21D 53/06*** | (2006.01) |
| ***B21C 37/00*** | (2006.01) |
| ***B21C 37/29*** | (2006.01) |

(52) U.S. Cl.

CPC ..... *F28D 1/05308* (2013.01); *B21C 37/00* (2013.01); *B21C 37/296* (2013.01); *B21D 53/06* (2013.01)

(58) Field of Classification Search

CPC ..... F28D 1/053; F28D 1/05308; B21D 53/06; B21C 37/00; F28F 9/0246; F28F 9/0248; F28F 11/00; F28F 2275/06

See application file for complete search history.

(56) References Cited

U.S. PATENT DOCUMENTS

| | | | | |
|---|---|---|---|---|
| 3,453,854 A * | 7/1969 | Lombardo | ..... | B21C 1/26 72/284 |
| 4,744,505 A | 5/1988 | Calleson | | |
| 5,407,004 A | 4/1995 | DeRisi et al. | | |
| 6,899,169 B1 * | 5/2005 | Cox | ..... | F28D 7/1607 165/157 |

(Continued)

*Primary Examiner* — Len Tran
*Assistant Examiner* — Kamran Tavakoldavani
(74) *Attorney, Agent, or Firm* — DeLio, Peterson & Curcio LLC; David R. Pegnataro

(57) ABSTRACT

A heat exchanger tube has a tube end having two extended portions substantially opposite the other around the periphery of the tube end, and two shortened portions, each positioned between the two extended portions and substantially opposite the other around the periphery of the tube end. The tube end may be formed by removing opposite portions of the tube by cutting a disc-shaped portion with a generally smoothly curving periphery along a major portion of the width of the tube. Each tube is oriented within an opening in the header wall of a heat exchanger assembly having a header portion integral with a tank portion, such that the tube end two extended portions are oriented substantially perpendicular to the direction of fluid flow within the header and the tube end two shorter portions are oriented substantially in the direction of fluid flow in order to reduce interference with fluid flow.

8 Claims, 8 Drawing Sheets

(56) References Cited

U.S. PATENT DOCUMENTS

| | | | | |
|---|---|---|---|---|
| 2002/0162648 | A1* | 11/2002 | Crook | F02B 29/0456 165/153 |
| 2011/0088883 | A1* | 4/2011 | de la Cruz | F28D 1/05391 165/173 |
| 2012/0222845 | A1* | 9/2012 | Kinder | F28F 13/12 165/154 |
| 2012/0247742 | A1* | 10/2012 | Mizuno | F28F 9/0209 165/173 |

* cited by examiner

HEAT EXCHANGER TUBE WITH CONCAVE-SHAPED END AND METHOD OF MANUFACTURING A HEAT EXCHANGER TUBE WITH CONCAVE-SHAPED END

RELATED APPLICATIONS

This application claims priority to U.S. Application No. 61/980,252, filed Apr. 16, 2014, and U.S. Application No. 61/980,288, filed Jul. 16, 2014.

BACKGROUND OF THE INVENTION

1. Field of the Invention

The present invention relates to heat exchangers and, more particularly, to liquid-to-air heat exchangers utilizing heat exchanger tubes having a concave-shaped end.

2. Description of Related Art

Heat exchangers, particularly those used in motor vehicles, may be liquid-to-air heat exchangers (e.g. radiators for engine coolant, air conditioning condensers and evaporators, and oil coolers) or may be air-to-air heat exchangers (e.g. charge air coolers). Liquid-to-air and air-to-air heat exchangers are typically composed of an inlet tank or manifold, an outlet tank or manifold, and a plurality of tubes extending between the tanks or manifolds which carry the fluid to be cooled. Headers are normally provided on the tanks for mechanical attachment and connection of the tubes.

A typical heat exchanger core is comprised of a plurality of vertical, parallel, spaced tubes, with extended surface fins attached between them for transferring heat to passing airflow. Tubes are inserted into, and sealed to, holes in the headers, which are connected to, or part of, the inlet and outlet tanks or manifolds. The tubes utilized may be round or oval, or may be oval with circular ends; however the ends of the tube are typically flat or squared-off, i.e. cut at right angles to the longitudinal axis of the tube.

Methods of manufacturing extruded aluminum multi-channel flat tubing for use in heat exchangers, such as vehicle air conditioning condensers, are well known. These methods basically consist of heating aluminum to its plastic state and forcing it through an extrusion die, which defines the tubing cross-section. Various guides and rollers are used to feed, straighten and pull the resulting tubing along. While the tubing is soft, a movable "flying cut-off" knife cuts at right angles through a major portion of the width of the tube to define its length. At this stage, the tubing is still connected to the main body of tubing by two small tits left by the "flying cut-off" knife, and when the tubing is sufficiently cooled, the feed portion of the tube mill is momentarily stopped or slowed, while the pull portion continues, breaking the tits and separating the tubing, resulting in the formation of a tube with a flat or squared-off end.

The tubes are inserted into the holes in the header or manifold, and the joints are soldered or brazed to prevent leakage around the tubes and header or manifold. Because of the squared-off end, the tubes necessarily protrude to some degree beyond the holes in the header or manifold, and into the tank.

In the case of some engine cooling radiators, the volume of the tank is such that the protrusion of the tubes into the tank has little effect in restricting fluid flow within the tank. However, in heat exchangers having small-diameter cylinders or round tubes as manifolds, such as in vehicle air conditioning condensers and oil coolers, tube protrusion into the manifold causes a serious restriction to fluid flow within the manifold, reducing heat exchanger performance or causing designers to call for larger diameter manifolds than might otherwise be required. Erosion of the end of the tube which protrudes into the manifold by high velocity fluid flow within the header is also a common occurrence.

Utilizing a heat exchanger tube in which the end of the tube is concave-shaped, rather than flat or squared-off, and cut to substantially conform to the cross-section of the mating manifold, would reduce tube protrusion. With reduced fluid flow restriction within the manifold, a smaller diameter manifold may be used, resulting in weight reduction and smaller space requirements, while also improving heat exchanger performance.

SUMMARY OF THE INVENTION

Bearing in mind the problems and deficiencies of the prior art, it is therefore an object of the present invention to provide an improved heat exchanger tube which eliminates the restriction of fluid flow within a header or manifold and further eliminates erosion of the portion of the tube end which protrudes into the header, while improving heat exchanger performance and preserving a complete tube-to-header joint.

It is another object of the present invention to provide a method of making a heat exchanger tube with concave-shaped ends to eliminate the restriction of fluid flow within a header or manifold and to eliminate erosion of the portion of the tube end which protrudes into the header, while improving heat exchanger performance and preserving a complete tube-to-header joint.

A further object of the present invention is to provide an improved heat exchanger which utilizes heat exchanger tubes with concave-shaped ends to eliminate the restriction of fluid flow within a header or manifold and to eliminate erosion of the portion of the tube end which protrudes into the header, while improving heat exchanger performance and preserving a complete tube-to-header joint.

It is yet another object of the present invention to provide an improved method of assembly of a heat exchanger which utilizes heat exchanger tubes with concave-shaped ends to eliminate the restriction of fluid flow within a header or manifold and to eliminate erosion of the portion of the tube end which protrudes into the header, while improving heat exchanger performance and preserving a complete tube-to-header joint.

Still other objects and advantages of the invention will in part be obvious and will in part be apparent from the specification.

The above and other objects, which will be apparent to those skilled in the art, are achieved in the present invention which is directed to a heat exchanger assembly comprising an elongated header having at least one inlet for passage of fluid into the header and further having a wall and a length, with fluid flow direction along the length of the header, a plurality of openings in the wall of the header to receive tubes, and a plurality of tubes, each of said tubes having a tube end secured in an opening in the wall of the header to form a tube-to-header joint. Each tube end has two extended portions, with each extended portion substantially opposite the other around the periphery of said tube end, and two shorter portions, with each shorter portion positioned between the two extended portions and substantially opposite each other around the periphery of said tube end. The two extended portions are oriented substantially perpendicular to the direction of fluid flow within the header and the two shorter portions are oriented substantially in the direction of fluid flow to reduce interference with fluid flow within the header.

In one embodiment, each tube-to-header joint of the heat exchanger assembly is sealed by soldering or brazing the periphery of the tube end to the header wall opening. Each tube may be secured and sealed in an opening in the wall of the header such that the tube end two shorter portions do not protrude substantially beyond the header wall opening into the header.

In another embodiment, each tube-to-header joint of the heat exchanger assembly is sealed by inserting a resilient grommet having a body portion for extending within the header wall opening into the header wall opening, and thereafter inserting a tube end through the grommet body portion and into the header wall opening. Each tube may be secured and sealed in an opening in the wall of the header such that the tube end two shorter portions do not protrude substantially beyond the header wall opening into the header.

In another aspect, the present invention is directed to a heat exchanger tube for insertion into an opening in a wall of an elongated header having a length with fluid flow direction along the length thereof. Each tube has a tube end having two extended portions, each extended portion substantially opposite the other around the periphery of the tube end, and two shorter portions, each shorter portion positioned between the two extended portions and substantially opposite each other around the periphery of the tube end.

In yet another aspect, the present invention is directed to a method of making a heat exchanger tube with a concave-shaped end for use in a heat exchanger, comprising the steps of providing a tube, removing opposite portions of the tube to form a tube end having two extended portions, each extended portion substantially opposite the other around the periphery of the tube end, and two shorter portions, each shorter portion positioned between the two extended portions and substantially opposite each other around the periphery of the tube end, and inserting and securing the tube end within an opening in a header wall of a heat exchanger to form a tube-to-header joint, such that the two extended portions are oriented substantially perpendicular to the direction of fluid flow within the header and the two shorter portions are oriented substantially in the direction of fluid flow to reduce interference with fluid flow within the header.

In one embodiment of the present invention, the step of removing opposite portions of the tube to form a tube end includes cutting a disc-shaped portion with a generally smoothly-curving periphery along a major portion of the width of the tube to form a tube end having two extended portions, each extended portion substantially opposite the other around the periphery of the tube end, and two shorter portions positioned between the two extended portions and substantially opposite each other around the periphery of the tube end. Opposite portions of the tube may be removed while feeding, straightening and pulling the tube through a tube mill having a feed portion and a pull portion, and the method may further include the step of momentarily stopping or slowing the feed portion of the tube mill while continuing the pull portion of the tube mill, during or after cutting a disc-shaped portion along a major width of the tube, in order to break the two small tits that remain and to separate the tube from the main body of tubing.

In yet another aspect, the present invention is directed to a method of making a heat exchanger assembly comprising the steps of providing an elongated header having a wall and a length with fluid flow direction along the length thereof, with the elongated header having at least one inlet for passage of fluid into the header and having a plurality of openings in the wall of the header to receive tubes, providing a tube for insertion within the header wall opening, with the tube having a tube end having two extended portions, each extended portion substantially opposite the other around the periphery of the tube end, and two shorter portions, each shorter portion positioned between the two extended portions and substantially opposite each other around the periphery of the tube end, and inserting and securing the tube end within the header wall opening to form a tube-to-header joint, such that the two extended portions are oriented substantially perpendicular to the direction of fluid flow within the header and the two shorter portions are oriented substantially in the direction of fluid flow to reduce interference with fluid flow within the header.

The method may further include the step of sealing the tube-to-header joint by soldering or brazing the periphery of the tube end to the header wall opening. In one embodiment, the method may further include the step of inserting and securing each tube end within a header wall opening such that the tube end two shorter portions do not protrude substantially beyond the header wall opening into the header. Each tube-to-header joint may then be sealed by soldering or brazing the periphery of each tube end to each header wall opening.

In another aspect, the present invention is directed to a method of making a heat exchanger assembly comprising the steps of providing an elongated header having a wall and a length with fluid flow direction along the length thereof, with the elongated header having at least one inlet for passage of fluid into the header and having a plurality of openings in the wall of the header to receive tubes, providing a tube for insertion within the header wall opening, with the tube having a tube end having two extended portions, each substantially opposite the other around the periphery of the tube end, and two shorter portions, each positioned between the two extended portions and substantially opposite each other around the periphery of the tube end, providing resilient grommets having a body portion for extending within a header wall opening, inserting the resilient grommets into the header wall openings, and inserting and securing the tube end into the header wall opening and through the grommet body portion to seal the tube end to the header wall opening, such that the two extended portions are oriented substantially perpendicular to the direction of fluid flow within the header and the two shorter portions are oriented substantially in the direction of fluid flow to reduce interference with fluid flow within the header.

The method may further include the step of inserting and securing each tube end within each header wall opening and through each grommet body portion such that the tube end two shorter portions do not protrude substantially beyond the header wall opening into the header.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-15 of the drawings in which like numerals refer to like features of the invention.

This invention is directed primarily toward a liquid-to-air heat exchanger, such as a radiator for engine coolant, an air conditioning condenser or evaporator, or an oil cooler. However, it may also be used in any other type of heat exchanger, for example, those discussed in the background of this invention, such as charge air coolers and the like.

The present invention provides a heat exchanger utilizing heat exchanger tubes having a concave-shaped end. The heat exchanger may have an elongated header or manifold having at least one inlet for passage of fluid into the header and having openings in the wall of the header or manifold into which heat exchanger tubes are inserted and secured to form tube-to-header joints and then sealed. Oval tubes are typically utilized for close tube spacing for optimum heat transfer performance of the heat exchanger, although other tube shapes and cross-sections may be utilized.

Figure 1:
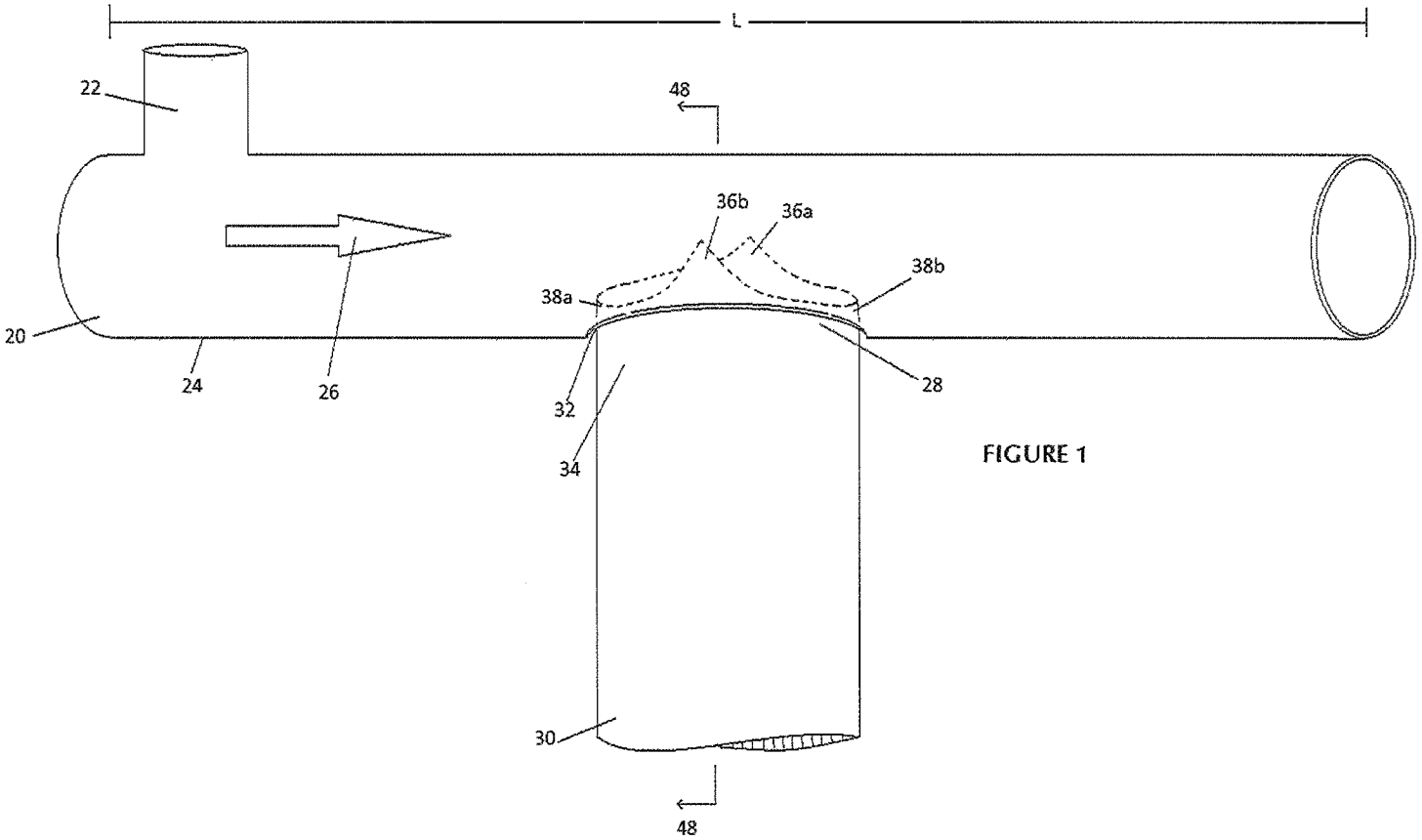
FIG. 1 is a perspective view of a segment of one embodiment of the heat exchanger assembly of the present invention, showing an inlet for passage of fluid into the header, an oval opening in the header wall for insertion of a heat exchanger tube, and an oval heat exchanger tube with concave-shaped end inserted and secured therein.

In accordance with the present invention, the heat exchanger employs a combined header and tank having a header portion integral with a tank portion. FIG. 1 shows a partial segment of elongated header 20, having inlet 22 for passage of fluid into header 20, opening 28 in header wall 24 for insertion of a heat exchanger tube, and heat exchanger tube 30 with concave-shaped end inserted and secured therein to form tube-to-header joint 32. Arrow 26 represents the direction of fluid flow within header 20.

The header wall openings may be oval and may be arranged in a single row to receive correspondingly-shaped oval tubes. As used herein, the term "oval" refers to any non-circular shaped axial cross-section (i.e. perpendicular to the axis of the tube) having a generally smoothly curving periphery, such as an ellipse or a rectangle with rounded corners, or other obround or egg shape. While oval-shaped tubes, and consequently oval-shaped header wall openings, are typically used, other tube and opening configurations can be used, such as circular or rectangular.

Figure 4:
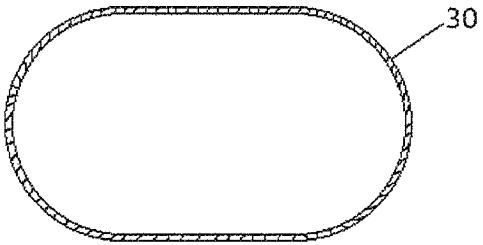
FIG. 4 is a cross-sectional view of the oval heat exchanger tube with concave-shaped end of FIG. 3.
Figure 3:
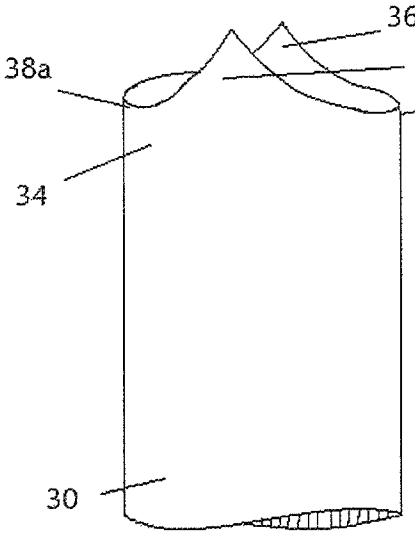
FIG. 3 is a perspective view of one embodiment of the heat exchanger tube with concave-shaped end of the present invention, showing an oval heat exchanger tube as in FIG. 1.
Figure 6:
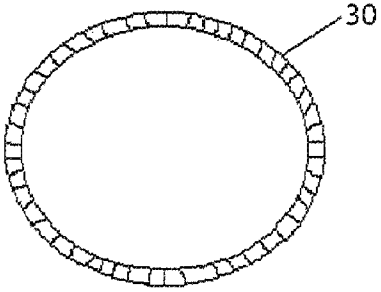
FIG. 6 is a cross-sectional view of the circular heat exchanger tube with concave-shaped end of FIG. 5.
Figure 5:
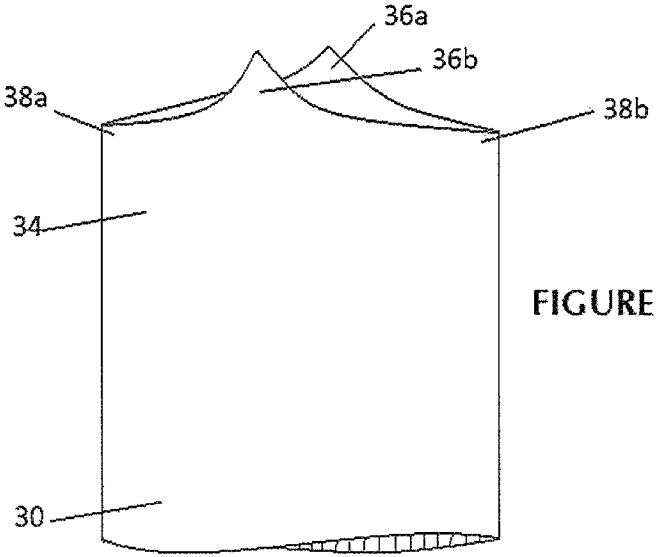
FIG. 5 is a perspective view of another embodiment of the heat exchanger tube with concave-shaped end of the present invention, showing a circular heat exchanger tube.

The heat exchanger assembly may employ of a plurality of tubes, each of said tubes having a tube end secured in an opening in the header wall to form a tube-to-header joint. Each tube end may be concave-shaped to substantially conform to the cross-section of the manifold or header. As more particularly shown in FIG. 3, each tube 30 has tube end 34 having two extended portions 36*a*, 36*b* substantially opposite the other around the periphery of tube end 34, and two shortened portions 38*a*, 38*b*, each shorter portion positioned between the two extended portions 36*a*, 36*b* and substantially opposite the other around the periphery of tube end 34. As shown in FIG. 4, the cross-section of the tube in this embodiment is oval. FIGS. 5 and 6 depict another embodiment of the heat exchanger tube of the present invention, in which the cross-section of the tube is circular.

Figure 2:
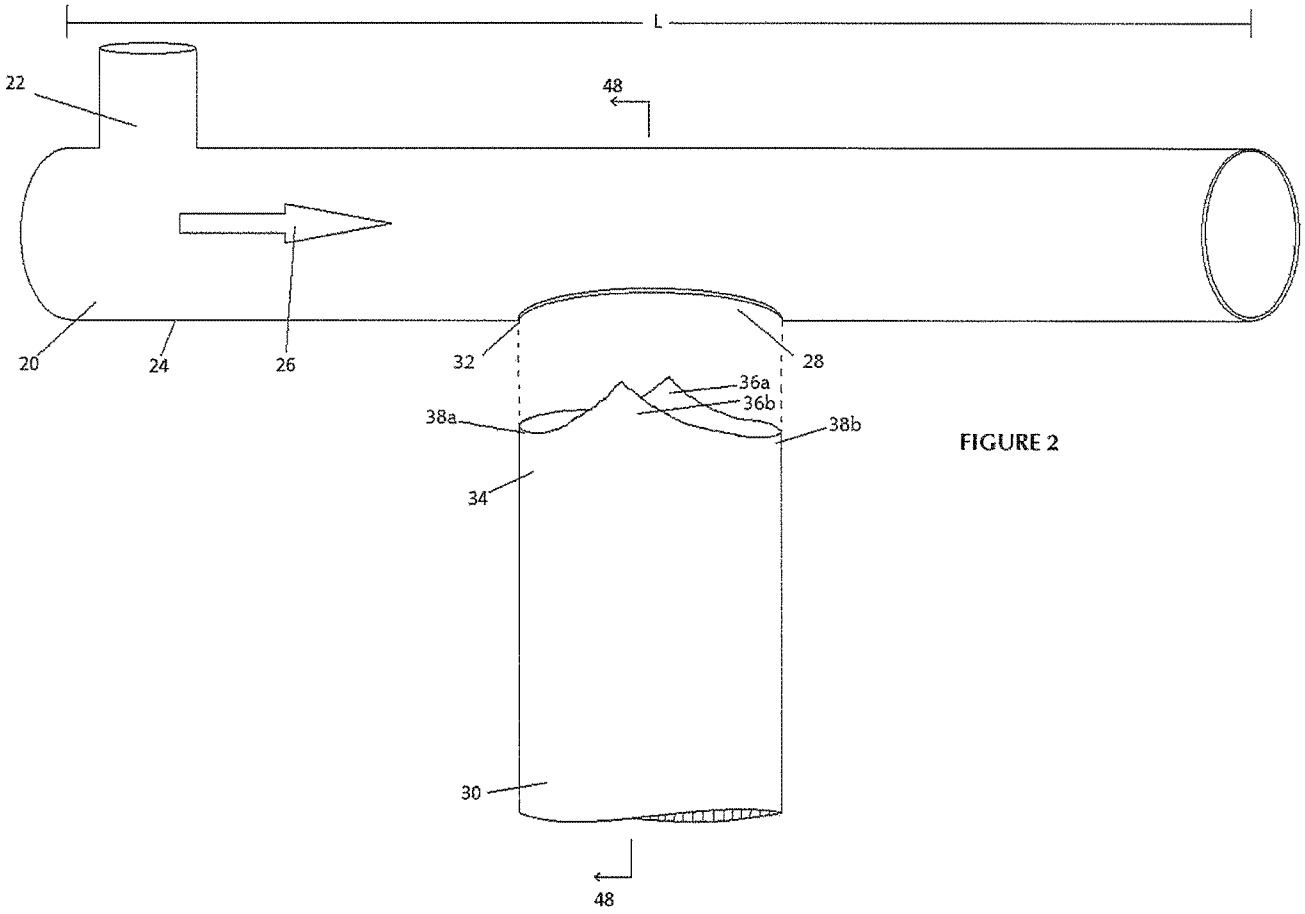
FIG. 2 is an exploded perspective view of the segment of the heat exchanger assembly of FIG. 1.
Figure 9:
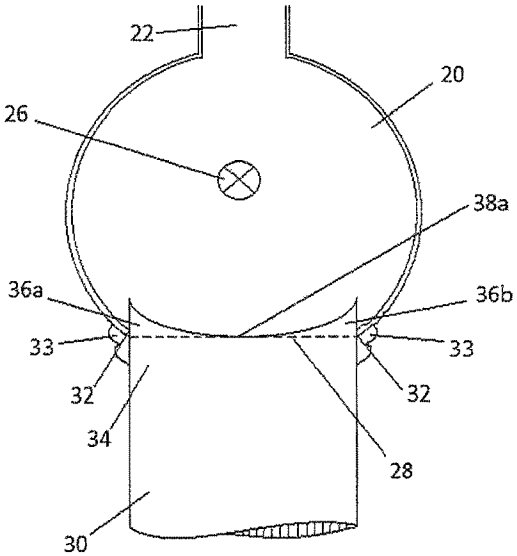
FIG. 9 is a cross-sectional view of another embodiment of the segment of the heat exchanger assembly of FIG. 1 taken along line 48-48, with fluid flow direction into the Figure and away from the viewer, showing the tube sealed to the header by solder or braze fillets.

As depicted in FIGS. 1 and 2, and more particularly depicted in FIG. 9, each tube 30 may be oriented within opening 28 in header wall 24 such that the tube end two extended portions 36*a*, 36*b* are oriented substantially perpendicular to the direction of fluid flow 26 within header 20 and the tube end two shorter portions 38*a*, 38*b* are oriented substantially in the direction of fluid flow 26 within header 20 in order to reduce interference with fluid flow. As shown in the drawings, the edge between an extended portion 36*a*, 36*b* and an adjacent shortened portion 38*a*, 38*b* is a continuous curve, so that the tube end appears to have a concave configuration when viewed in a direction normal to the longitudinal axis of the tube and in a direction along the shortened portions 38*a*, 38*b*, between the extended portions 36*a*, 36*b*.

Figure 8:
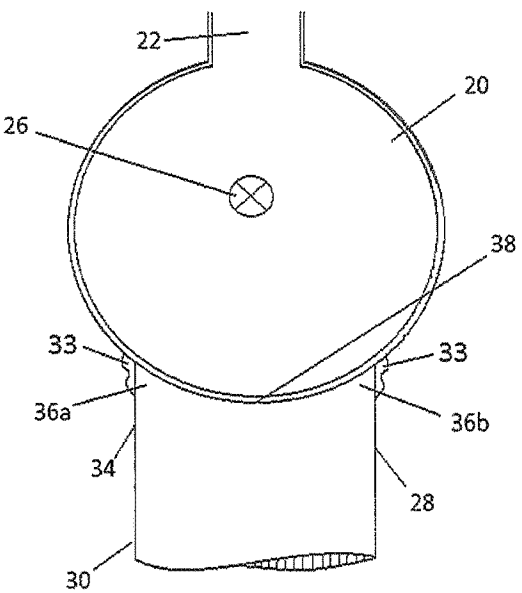
FIG. 8 is a cross-sectional view of one embodiment of the segment of the heat exchanger assembly of FIG. 1 taken along line 48-48, with fluid flow direction into the Figure and away from the viewer.

As shown in FIGS. 8 and 9, tube end 34 may be inserted and secured within header wall opening 28 such that the tube end two shorter portions 38*a*, 38*b* are aligned in the direction of fluid flow and the concave configuration of tube end 34 substantially matches the curvature of the wall of header 20. In FIG. 8, the concave configuration of tube end 34 matches the curvature of the wall of header 20, and in FIG. 9, the concave configuration of tube end 34 does not precisely match the curvature of the wall of header 20, and protrudes to a small degree into the interior of header 20. These configurations will eliminate (FIG. 8) or reduce (FIG. 9) the restriction of fluid flow within header 20 and preserve a complete tube-to-header joint 32. Further, erosion of the tube ends 34 within header 20 by high velocity fluid flow within header 20 is eliminated or reduced. The tube end two longer and two shorter portions may protrude a distance beyond the header wall opening, while permitting substantially unimpeded fluid flow in the concave area between adjacent longer and shorter ends such that fluid flow velocity is substantially preserved.

Figure 10:
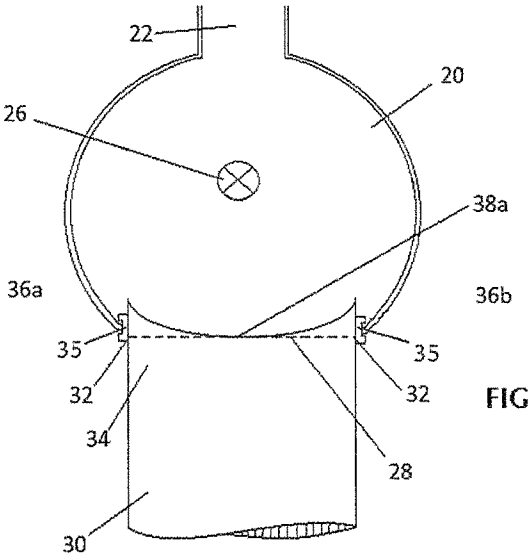
FIG. 10 is a cross-sectional view of yet another embodiment of the segment of the heat exchanger assembly of FIG. 1 taken along line 48-48, with fluid flow direction into the Figure and away from the viewer, showing the tube sealed to the header by a resilient grommet.

Tube-to-header joint 32 may be sealed by soldering or brazing the periphery of tube end 34 to header wall opening 28, as shown by solder or braze fillets 33 in FIGS. 8 and 9. Alternatively, tube-to-header joint 32 may be sealed using resilient grommets. This is shown in FIG. 10, where tube end 34 is inserted into and sealed to header 20 by a resilient grommet 35. Other methods of sealing the tube-to-header joints such as welding, adhesive bonding, and the like, may also be used.

The present invention is further directed to a method of manufacturing a heat exchanger tube having a concave-shaped end for use in a heat exchanger. Said method comprises providing heat exchanger tube 30 and removing opposite portions of tube 30 to form a tube end 34 having two extended portions 36*a*, 36*b* substantially opposite the other around the periphery of tube end 34, and two shortened portions 38*a*, 38*b*, each shorter portion positioned between the two extended portions 36*a*, 36*b* and substantially opposite the other around the periphery of tube end 34.

Figure 7:
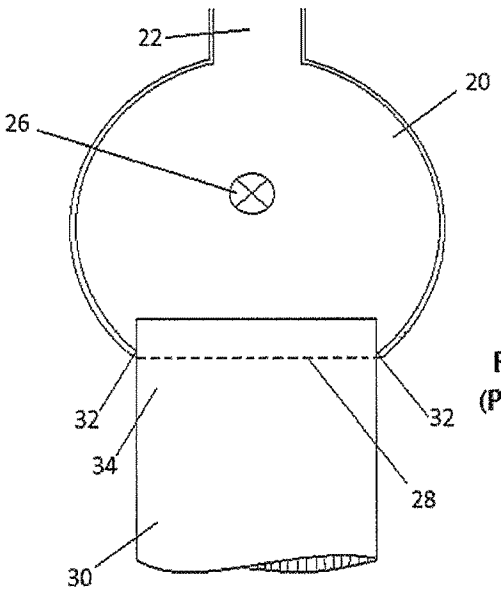
FIGURE 7 (PRIOR ART)
FIG. 7 is a cross-sectional view of a typical prior art heat exchanger tube protruding into a header, with fluid flow direction into the Figure and away from the viewer.
Figure 11:
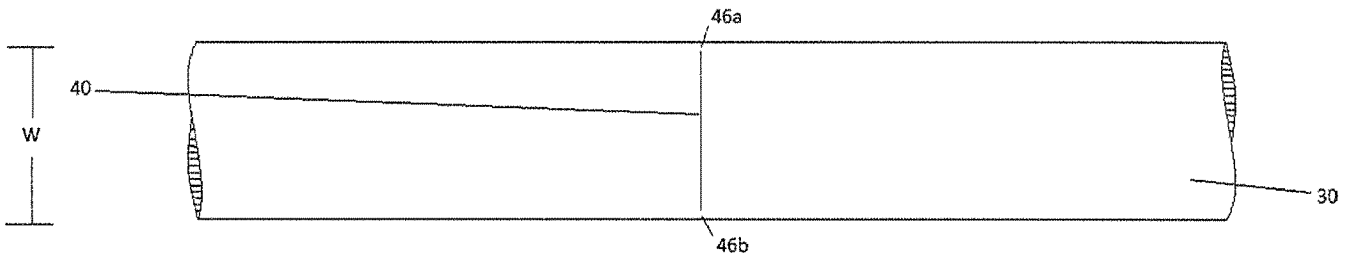
FIGURE 11 (PRIOR ART)
FIG. 11 is a side view of tubing with a 90° cut-off used to make a typical prior art heat exchanger tube, prior to separation of the tubing.
Figure 12:
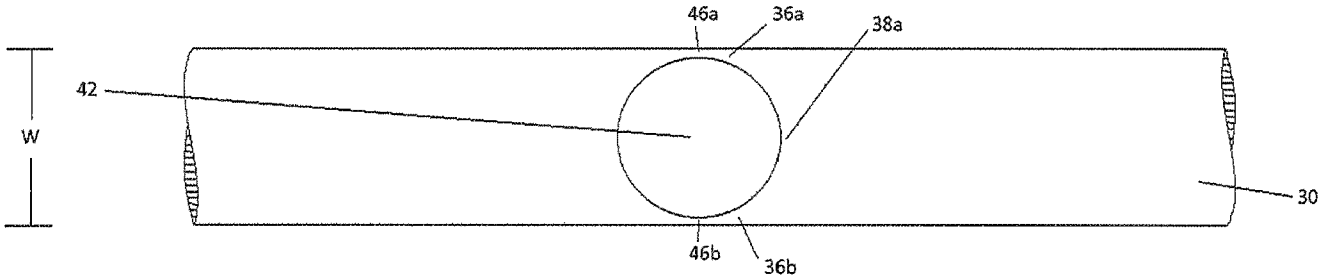
FIG. 12 is a side view of an alternative embodiment of the tubing used to make the heat exchanger tube with concave-shaped end of the present invention, showing a circular cut-off along the width of the tubing to form a tube end, prior to separation of the tubing.
Figure 13:
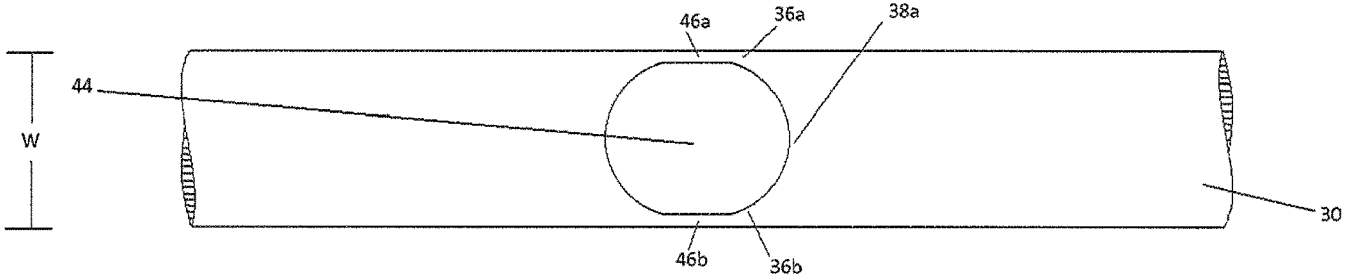
FIG. 13 is a side view of another alternative embodiment of the tubing used to make the heat exchanger tube with concave-shaped end of the present invention, showing a disc-shaped cut-off along the width of the tubing to form a tube end, prior to separation of the tubing.

As shown in FIGS. 7 and 11 (depicting prior art), respectively, the end of a typical heat exchanger tube is generally flat, due to having been cut with a right angle cut-off 40 from a longer piece of tubing to determine the tube's length. The present invention is directed to a method of manufacturing a heat exchanger tube having a concave-shaped, as opposed to flat, end. The process for producing an extruded aluminum multi-channel tube extends beyond the common method for producing such tubing in a tube mill, beginning with the point of tubing cut-off. At that point, rather than making a typical right-angle cut in the tubing, the cut-off knives cut a disc-shaped portion with a generally smoothly-curving periphery out of the tubing. As shown in FIGS. 12 and 13, respectively, tube end 34 having two extended portions 36*a*, 36*b* and two shorter portions 38*a*, 38*b* may be formed by using circular cut-off 42 or disc-shaped cut-off 44 along a major portion of width W of the tubing. Other closed-figure cuts having a generally smoothly curving periphery are not precluded, as they may also result in the formation of a tube end having two extended portions and two shorter portions. Due to the customization afforded by the method, tube end 34 may be cut to substantially conform to the cross-section of header 20, as depicted in FIG. 8.

Figure 15:
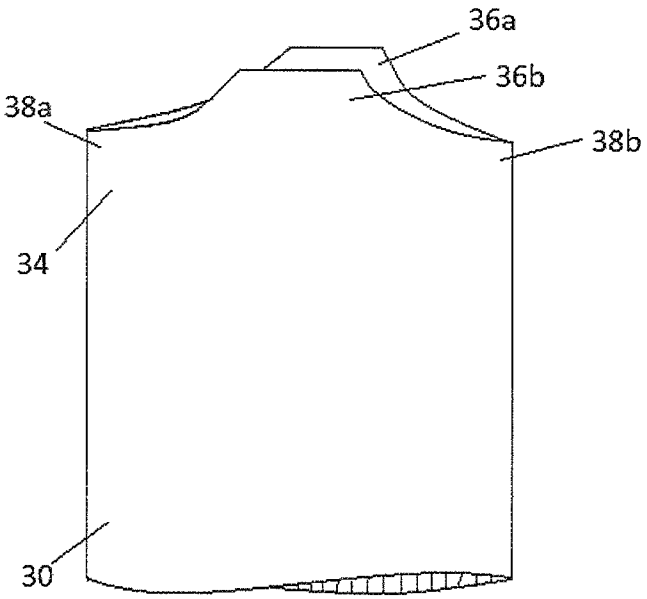
FIG. 15 is a perspective view of the second alternative embodiment of the heat exchanger tube with concave-shaped end of the present invention after breaking the small tits and separating the tubing of FIG. 13.
Figure 14:
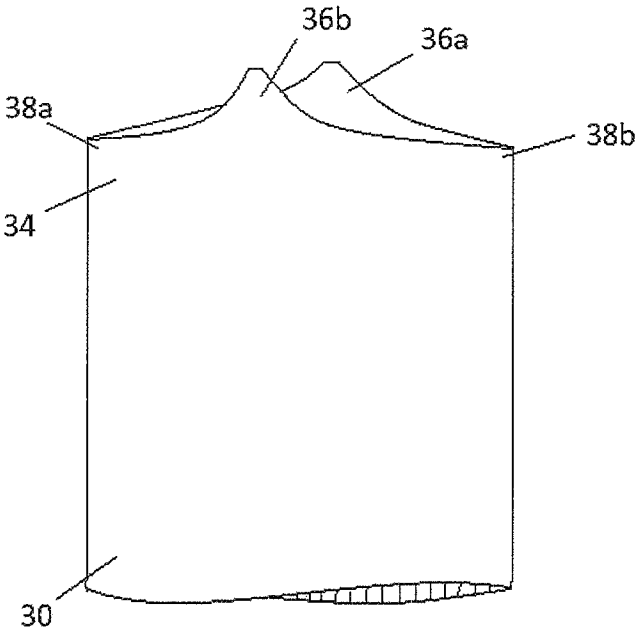
FIG. 14 is a perspective view of the alternative embodiment of the heat exchanger tube with concave-shaped end of the present invention after breaking the small tits and separating the tubing of FIG. 12.

Tube 30 will remain attached to the tubing until it is separated by breaking small tits 46*a*, 46*b* on either side of the cut portion of the tubing. This may be achieved by momentarily stopping or slowing the feed portion of the tube mill while continuing the pull portion of the tube mill, during or after cutting a portion along a major width of the tube. Two alternative embodiments of the present invention are shown in FIGS. 14 and 15, which show tube 30 having a concave-shaped tube end 34 formed after breaking small tits 46*a*, 46*b* and separating the tubing of FIGS. 12 and 13, respectively.

The present invention is further directed to a method of manufacturing a heat exchanger utilizing heat exchanger tubes having a concave-shaped end. The method comprises providing elongated header 20, providing tube 30 having tube end 34 with two extended portions 36*a*, 36*b* and two shortened portions 38*a*, 38*b*, and inserting and securing tube end 34 within header wall opening 28 to form tube-to-header joint 32 such that the two extended portions 36*a*, 36*b* are oriented substantially perpendicular to the direction of fluid flow within header 20 and the two shorter portions 38*a*, 38*b* are oriented substantially in the direction of fluid flow.

Tube end 34 may be shaped to substantially conform to the cross-section of header 20 and may be inserted and secured within header wall opening 28 such that two shorter portions 38*a*, 38*b* do not protrude beyond header wall opening 28 and into header 20. This will ensure that any restriction of fluid flow within the manifold is eliminated and further that any erosion of the tube end due to high velocity fluid flow within the header is eliminated. However, the tube end two longer and two shorter portions may protrude a distance beyond the header wall opening such that fluid flow velocity is substantially preserved.

Tube-to-header joint 32 may be sealed by soldering or brazing the periphery of tube end 34 to header wall opening 28, but may also be sealed using resilient grommets, as shown in FIG. 10. Other methods of sealing the tube-to-header joint such as welding, adhesive bonding, and the like, may also be used.

Thus, the present invention provides an improved heat exchanger tube which substantially eliminates the restriction of fluid flow within a header or manifold and further substantially eliminates erosion of the portion of the tube end which protrudes into the header, while improving heat exchanger performance and preserving a complete tube-to-header joint. The present invention also provides an improved heat exchanger and a method of making such a heat exchanger tube with concave-shaped ends to achieve these advantages.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A heat exchanger assembly comprising:

an inlet manifold including an elongated header portion having a wall, the manifold having at least one inlet for passage of fluid into the manifold, the manifold further having a length, with fluid flow direction along the length of the manifold;

a plurality of openings in the wall of the header to receive tubes for carrying fluid between the inlet manifold and an outlet manifold; and a plurality of tubes extending between the inlet manifold and the outlet manifold for carrying fluid between the inlet manifold and the outlet manifold, each of said tubes having a tube end secured in an opening in the wall of the header to form a tube-to-header joint such that the tube end of each of the plurality of tubes does not protrude beyond said header wall opening into said inlet manifold, said tube end having two extended portions, each extended portion opposite the other around the periphery of said tube end, and two shorter portions, each shorter portion between said two extended portions and opposite each other around the periphery of said tube end, said two extended portions oriented perpendicular to said fluid flow direction along the length of the manifold and said two shorter portions positioned to not protrude beyond said header wall opening into said header and oriented in the direction of said fluid flow direction to reduce interference with fluid flow within the manifold as fluid flows past the tube end shorter portions between the extended portions along the length of the manifold, the tube end being shaped to conform to a cross-section of the header wall when viewed in a direction normal to a longitudinal axis of the tube and in a direction along the shorter portions between the extended portions.

2. The heat exchanger assembly of claim 1 wherein said tube-to-header joint is sealed by soldering or brazing the periphery of the tube end to said header wall opening.

3. The heat exchanger assembly of claim 1 wherein said tube-to-header joint is sealed by inserting a resilient grommet having a body portion for extending within said header wall opening into said header wall opening, and thereafter inserting said tube end through said grommet body portion and into said header wall opening.

4. A method of making a heat exchanger tube with a concave-shaped end for use in a heat exchanger, comprising the steps of:

a) providing a tube;

b) removing opposite portions of the tube by cutting a disc-shaped portion with a generally smoothly-curving periphery along a major portion of the width of said tube to form a tube end having two extended portions, each extended portion opposite the other around the periphery of said tube end, and two shorter portions, each shorter portion between said two extended portions and opposite each other around the periphery of said tube end, the tube end being shaped to conform to a cross-section of a header wall when viewed in a direction normal to a longitudinal axis of the tube and in a direction along the shorter portions between the extended portions; and c) inserting and securing said tube end within an opening in the header wall of a heat exchanger manifold to form a tube-to-header joint such that said tube end does not protrude beyond said header wall opening into said manifold and such that said two extended portions are oriented perpendicular to fluid flow direction along a length of the manifold and said two shorter portions are oriented in the direction of said fluid flow to reduce interference with fluid flow within the manifold as fluid flows past the tube end shorter portions between the extended portions along the length of the manifold.

5. The method of claim 4 wherein opposite portions of the tube are removed while feeding, straightening and pulling the tube through a tube mill having a feed portion and a pull portion, and further including the step of momentarily stopping or slowing the feed portion of said tube mill while continuing the pull portion of said tube mill, during or after cutting said disc-shaped portion along a major width of the tube.

6. A method of making a heat exchanger assembly comprising the steps of:

a) providing an inlet manifold including an elongated header portion having a wall, the manifold having a length with fluid flow direction along the length thereof, said manifold having at least one inlet for passage of fluid into the manifold and having a plurality of openings in the wall of the header to receive a tube;

b) providing a tube for carrying fluid between the inlet manifold and an outlet manifold, said tube having a tube end having two extended portions, each extended portion opposite the other around the periphery of said tube end, and two shorter portions, each shorter portion between said two extended portions and opposite each other around the periphery of said tube end, the tube end being shaped to conform to a cross-section of the header wall when viewed in a direction normal to a longitudinal axis of the tube and in a direction along the shorter portions between the extended portions; and c) inserting and securing said tube end within said inlet manifold header wall opening to form a tube-to-header joint, such that said tube end does not protrude beyond said header wall opening into said manifold and such that said two extended portions are oriented perpendicular to said fluid flow direction along the length of the manifold and said two shorter portions are positioned to not protrude beyond said header wall opening into said header and oriented in the direction of said fluid flow direction to reduce interference with fluid flow within the manifold as fluid flows past the tube end shorter portions between the extended portions along the length of the manifold, said tube extending between the inlet manifold and the outlet manifold.

7. The method of claim 6 further comprising the step of sealing said tube-to-header joint by soldering or brazing the periphery of the tube end to said header wall opening.

8. A method of making a heat exchanger assembly comprising the steps of:

a) providing an inlet manifold including an elongated header portion having a wall, the manifold having a length with fluid flow direction along the length thereof, said manifold having at least one inlet for passage of fluid into the manifold and having a plurality of openings in the wall of the header to receive a tube;

b) providing a tube for carrying fluid between the inlet manifold and an outlet manifold, said tube having a tube end having two extended portions, each opposite the other around the periphery of said tube end, and two shorter portions, each between said two extended portions and opposite each other around the periphery of said tube end, the tube end being shaped to conform to a cross-section of the header wall when viewed in a direction normal to a longitudinal axis of the tube and in a direction along the shorter portions between the extended portions;

c) providing resilient grommets having a body portion for extending within said header wall opening;

d) inserting said resilient grommets into said inlet manifold header wall openings; and e) inserting and securing said tube end into said header wall opening and through said grommet body portion to seal said tube end to said header wall opening, such that said tube end does not protrude beyond said header wall opening into said manifold and such that said two extended portions are oriented perpendicular to said fluid flow direction along the length of the manifold and said two shorter portions are positioned to not protrude beyond said header wall opening into said header and oriented in the direction of said fluid flow direction to reduce interference with fluid flow within the manifold as fluid flows past the tube end shorter portions between the extended portions along the length of the manifold, said tube extending between the inlet manifold and the outlet manifold.

* * * * *